US005312065A

United States Patent [19]

Shore et al.

[11] Patent Number: 5,312,065

[45] Date of Patent: May 17, 1994

[54] ROD LAYING HEAD WITH FRONT AND TAIL END RING CONTROL

[75] Inventors: Terence M. Shore, Princeton; Harold E. Woodrow, Northboro, both of Mass.

[73] Assignee: Morgan Construction Company, Worcester, Mass.

[21] Appl. No.: 831,170

[22] Filed: Feb. 5, 1992

[51] Int. Cl.[5] ..... B21C 47/02; B21F 3/02

[52] U.S. Cl. ..... 242/82; 72/135; 72/66

[58] Field of Search ..... 242/82, 77, 78, 79; 72/66, 135

[56] References Cited

U.S. PATENT DOCUMENTS

| | | | |
|---|---|---|---|
| 2,833,329 | 5/1958 | De Poy | 242/82 |
| 3,270,979 | 9/1966 | Whitacre | 242/82 |
| 3,563,488 | 2/1971 | Bollig | 242/82 |
| 3,669,377 | 6/1972 | Gilvar et al. | 242/82 |
| 3,843,072 | 10/1974 | Rayfield | 242/82 |
| 4,242,892 | 1/1981 | Wykes et al. | 242/82 |
| 4,765,556 | 8/1988 | Nasrah | 242/82 |
| 4,944,469 | 7/1990 | Wilson | 242/82 |
| 5,018,678 | 5/1991 | Peterson | 242/82 |

*Primary Examiner*—William A. Cuchlinski, Jr.
*Assistant Examiner*—C. W. Fulton
*Attorney, Agent, or Firm*—Samuels, Gauthier & Stevens

[57] ABSTRACT

A laying head for forming axially moving elongated products into series of rings. The laying head includes an auxiliary guide which is readily dismantled from the laying head in order to accommodate the rolling of larger diameter slower speed products. The guide includes the provision of a helical extension of the guide path defined by the rotating three-dimensionally curved pipe of the laying head. The helical extension is subdivided into an outer cylindrical shroud surrounding the rotational path of the outlet end of the laying pipe, and an inner helical trough having its open side facing the shroud. The helical trough includes a central hub adapted to be detachably secured to the tubular pipe support carrying the laying pipe. The central hub and the tubular pipe support include coacting surfaces which insure that the components are reliably assembled for balanced rotation.

37 Claims, 3 Drawing Sheets

ROD LAYING HEAD WITH FRONT AND TAIL END RING CONTROL

BACKGROUND OF THE INVENTION

1. Field of the Invention

This invention relates generally to rod rolling mills, and is concerned in particular with an improvement in the laying heads used to form the rods exiting from such mills into helical formations of so called "rings".

2. Description of the Prior Art

Referring initially to FIGS. 1 and 2, the typical delivery end of a rod mill is depicted schematically as including the last roll stand of a finishing block 10, several water boxes 12, 14, a pinch roll unit 16, a laying head 18, a cooling conveyor 20 and a reforming tub 22. The finished rod exits from finishing block 10 at an elevated temperature in the range of 650° to 950° C. The rod is quenched in the water boxes 12, 14 before passing through the pinch roll unit 16 into the laying head 18. The laying head forms the product into a helical formation of rings 24 which are received on and transported along the length of the conveyor 20 towards the reforming tub 22. While on the conveyor, the rings are arranged in a Spencerian formation and subjected to various heat treatments, e.g., controlled cooling at selected rates to achieve selected metallurgical properties. The rings drop from the delivery end of the conveyor into the reforming tub 22 where they are gathered around a vertical mandrel 26 into upstanding cylindrical coils. Other devices (not shown) remove the coils from the tub for transport to other locations.

It is important to maintain a uniform ring pattern on the conveyor 20, with the diameters of the rings being such that they will drop smoothly into the reforming tub without being caught up on either the outer tub circumference or the central mandrel 26. Either of such occurrences will foul the equipment, necessitating a costly interruption in production.

While a segment of the rod is being rolled in the mill and another segment of the rod is passing through the laying head where it is being formed into rings that are being deposited on the conveyor, operating conditions remain substantially steady. Thus, a uniform ring pattern can be maintained by synchronizing the operating speed of the laying head with the speed at which the rod is being delivered from the mill.

When the tail end of the rod leaves the mill, the pinch roll unit 16 comes into play and serves to continue stabilizing operating conditions. Thus, when smaller diameter products on the order of 5.5 mm are being rolled at higher speeds in the range of 100 m/sec, the pinch roll unit will act as a brake resisting the tendency of the product to speed up after the tail end drops out of the finishing block. By the same token, when larger diameter products on the order of 12–20 mm are being rolled at slower speeds ranging from 11 to 30 m/sec, the pinch roll unit will serve to continue propelling the product through the laying head after the tail end drops out of the finishing block.

A problem arises, however, when the tail end of the product leaves the pinch roll unit 16. The distance "d" between the pinch roll unit and the delivery end of the laying head 18 is typically about 4 meters, which is equal to or slightly greater than the circumference of one ring being deposited on the conveyor. Under high speed operating conditions, when the tail end clears the pinch roll unit, that relatively short product length tends to speed up, causing buckling and/or an increase in the diameter of the last ring. This in turn can hinder passage of the last ring downwardly into the reforming tub.

A related although somewhat different problem can be experienced with the front end of the product as it leaves the laying head and before it contacts the conveyor. During this brief interval, conditions are again unsteady, and consequently the shape of the lead ring may be deformed or hooked. This can result in the lead end becoming snarled on the reforming tub's mandrel 26.

Attempts have been made at resolving the above-described problems by varying the operating speed of the laying head to suit changing operating conditions. However, at mill delivery speeds of 100 m/sec. and higher, laying head inertia is difficult if not impossible to overcome during the narrow time frame within which front and tail ends are travelling in an unsteady state.

SUMMARY OF THE PRESENT INVENTION

A primary objective of the present invention is to provide the laying head with an auxiliary guide which is adapted to stabilize and improve the shape of the front and tail ends of the smaller diameter high speed products.

Another objective of the present invention is the provision of an auxiliary guide which can be readily dismantled from the laying head in order to accommodate the rolling of larger diameter slower speed products.

A companion objective of the present invention is the provision of means for reliably centering and stabilizing the auxiliary guide on the laying head for rotation in a balanced state.

The invention achieves the foregoing objectives by providing a helical extension of the guide path defined by the rotating three dimensionally curved pipe of the laying head. The helical extension is subdivided into an outer cylindrical shroud surrounding the rotational path of the outlet end of the laying pipe, and an inner helical trough having its open side facing the shroud.

The helical trough has a central hub adapted to be detachably secured to the tubular pipe support carrying the laying pipe. The central hub and the tubular pipe support include coacting surfaces which insure that the components are reliably assembled for balanced rotation.

Preferably, the helical extension defines at least one complete revolution about the rotational axis of the laying pipe. Optionally, the cylindrical shroud can be mounted for independent rotation about the rotational axis of the laying pipe.

BRIEF DESCRIPTION OF THE DRAWINGS

A preferred embodiment of the invention will now be described, by way of example only, with reference to the accompanying drawings, wherein.

DETAILED DESCRIPTION OF ILLUSTRATED EMBODIMENT

Figure 1:
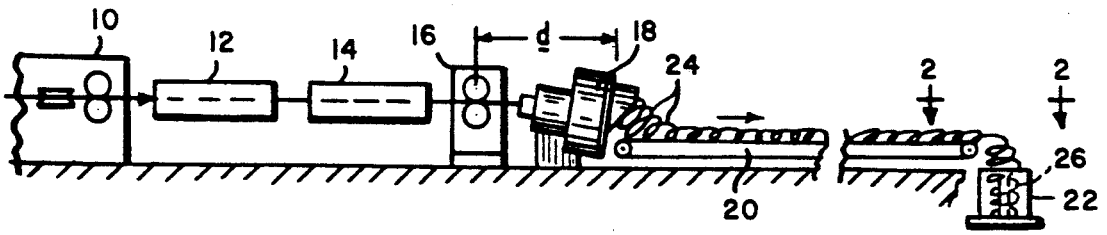
FIG. 1 PRIOR ART
FIG. 1 is a diagrammatic illustration of the delivery end of a typical rod rolling mill.
Figure 2:
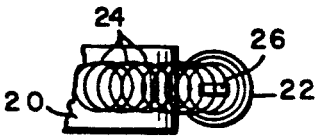
FIG. 2 PRIOR ART
FIG. 2 is a top plan view taken on line 2—2 of FIG. 1.

Referring additionally to FIG. 3–7, it will be seen that the laying head 18 includes a fixed housing 28 having an entry portion 28*a* and a delivery portion 28*b* with a rearwardly extending guard 28*c*. The entry portion 28*a* has axially spaced bearings 32, 34 rotatably supporting a tubular support 36. The tubular support may be conveniently subdivided into axially aligned components 36*a*, 36*b* with flanged ends bolted together as at 38. Tubular support component 36*a* carries a bevel gear 40 meshing with a bevel gear 42 on a right angle shaft 44. Although not shown, it will be understood that the shaft 44 is driven by a motor arranged externally of the entry housing portion 28*a*. Rotation of shaft 44 acts through the intermeshed gears 40, 42, to rotatably drive the tubular support 36 about its longitudinal axis "A".

A three dimensionally curved laying pipe 46 is carried on the tubular support 36 for rotation therewith. Although not shown, it will be understood that the laying pipe 46 is joined to the tubular support 36 by a conventional structure, one example being a spiral web projecting radially from the support. Such connecting structures are well known to those skilled in the art. The laying pipe 46 has an entry end 46*a* aligned with axis A and located immediately downstream from an entry guide sleeve 48 inserted into the front end of tubular support component 36*a*. An intermediate portion 46*b* of the laying pipe defines a three dimensionally curved guide path leading from the entry end 46*a* to an exit end 46*c* spaced radially from and arranged to rotate about axis A.

During a rolling operation, the rod enters the laying head along axis A. The rod passes through the guide sleeve 48 into the entry end 46*a* of the rotating laying pipe 46. The rotational speed of the laying pipe and the curvature of its intermediate section 46*b* are such that the rod emerges from exit end 46*c* as a series of continuous rings 24 (see FIG. 1).

The present invention provides an extension of the curved guide path defined by the laying pipe 46. The guide path extension is defined by inner and outer components generally indicated at 50 and 52, the inner component being rotatable with the laying pipe 46 and its tubular support 36 relative to the outer component, which may or may not be independently rotatable.

The outer component 52 of the guide path extension comprises a cylindrical shroud 54 located in a space provided between the downstream end 56 of the housing delivery portion 28*b* and the stationary rearwardly extending guard 28*c*. An externally toothed ring gear 58 is secured to the shroud. A large diameter bearing 60 rotatably supports the ring gear 58 on a collar 62 attached to the guard 28*c*. The ring gear 58 is engaged by a pinion 64 driven by a motor 66.

The inner component 50 of the guide path extension comprises a helical trough 68 having its open side facing radially outwardly towards the surrounding cylindrical shroud 54. The trough 68 is supported on the edge of a spiral web 70 having a central opening in which is fixed a hub assembly generally indicated at 72.

Figure 4:
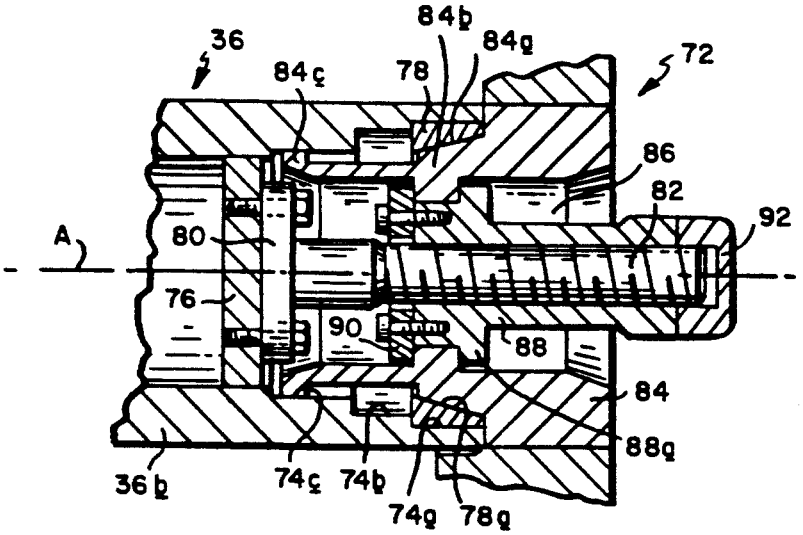
FIG. 4 is an enlarged sectional view showing the means for centering and detachably coupling the rotatable component of the auxiliary guide to the rotatable laying pipe support.
Figure 8:
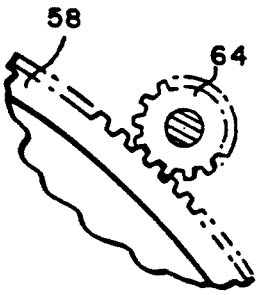
FIG. 8 is a sectional view taken along line 8—8 of FIG. 3.
Figure 3:
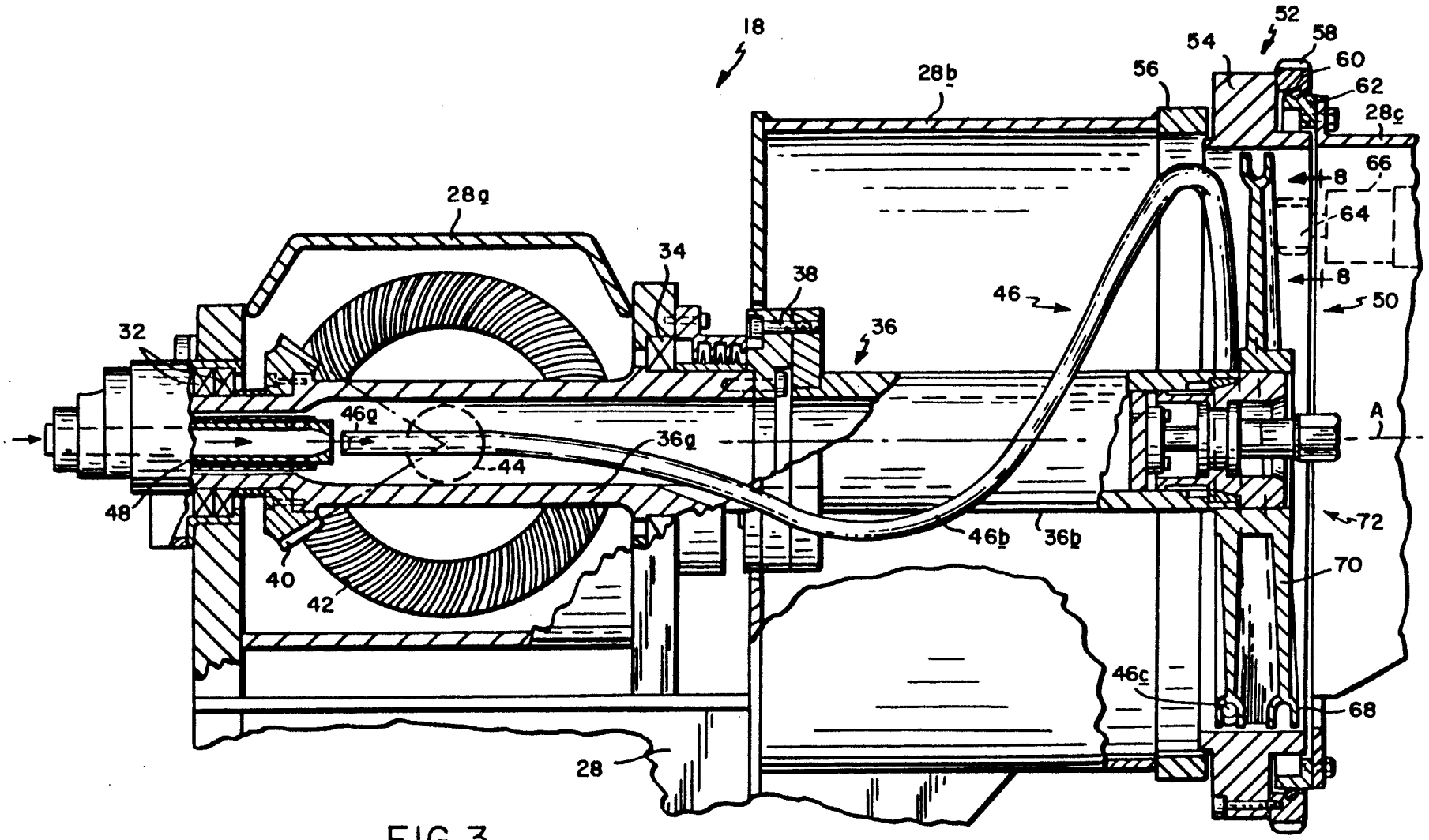
FIG. 3 is a longitudinal sectional view on an enlarged scale of the laying head shown in FIG. 1, with portions broken away to better illustrate internal components.

As can best be seen in FIG. 4, the rear end of tubular support component 36*b* has internally stepped progressively reduced diameter sections 74*a*, 74*b*, 74*c* leading to a wall 76. An insert 78 having an internally tapered surface 78*a* is fixed within section 74*a*. A base plate 80 having an axially extending threaded stem 82 is secured to a wall 76. The stem 82 protrudes axially beyond the end of the support component 36*b*.

The hub assembly 72 includes a cylindrical 84 hub defining an internal through passageway 86. The hub has an externally tapered surface 84*a*, a circular flange 84*b* protruding radially inwardly into the passageway 86, and an external circular shoulder 84*c* spaced axially from tapered surface 84*a*. An internally threaded sleeve 88 is received in the passageway 86. Sleeve 88 has an external shoulder 88*a* coacting with an annular keeper plate 90 secured to its inner end to grip the internal flange 84*b* therebetween. The outer end of sleeve 88 is closed by a cap 92.

When mounting the inner component 72 of the guide path extension on the laying pipe support 36, the hub 84 is axially inserted into the end of the tubular support component 36*b*, and the sleeve 88 is threaded onto stem 82. As the sleeve 88 is tightened, the inner and outer tapered surfaces 78*a*, 84*a* are brought into coactive wedged engagement, thereby insuring that the hub 84 is centered on axis A. At the same time, the external circular shoulder 84*c* on the inner hub end coacts with the internal stepped surface 74*c* of the hub component 36*b* to import a stabilizing effect to the hub. The net result is that by tightening the threaded sleeve 88, the entire inner component 72 of the guide path extension is securely mounted on the laying pipe support 36 for rotation therewith in a balanced state.

Figure 6:
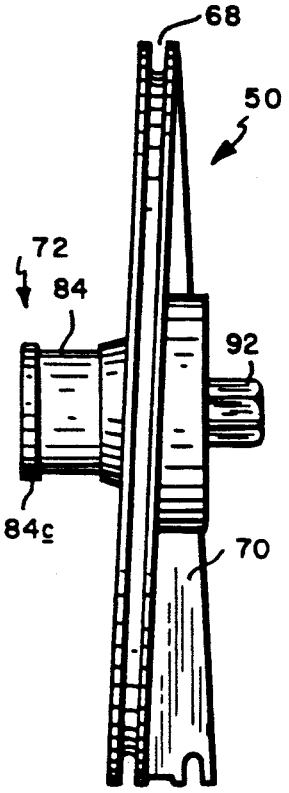
FIG. 6 is a side view of the rotatable component.
Figure 5:
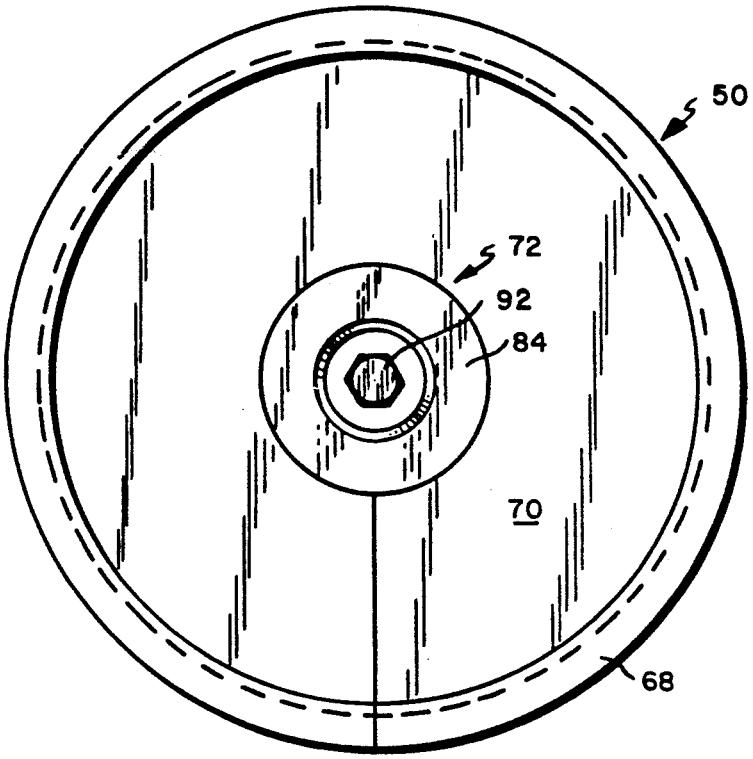
FIG. 5 is a front view of the rotatable component of the auxiliary guide.
Figure 7:
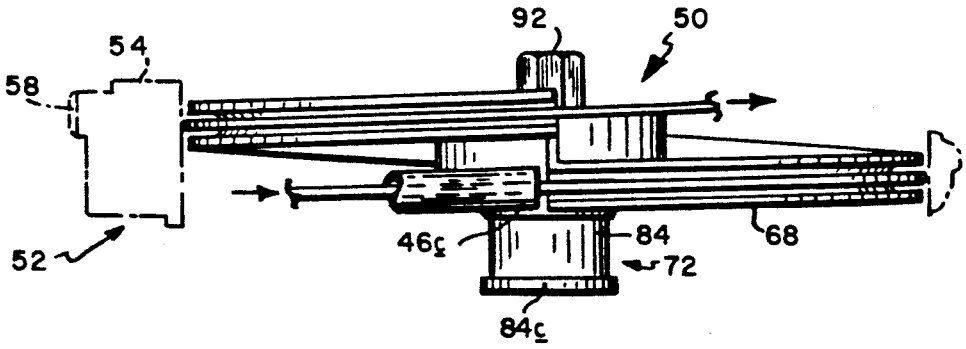
FIG. 7 is a bottom view of the rotatable component.

It will be seen from FIGS. 5–7 that the helical trough 68 defines at least one complete revolution about axis A. The receiving end of the trough is located directly adjacent to and in communication with the outlet end 46*c* of laying pipe 46. Thus, trough 68 coacts with the shroud 54 in providing a helical extension of the guide path defined by the laying pipe 46.

For the higher speed smaller diameter products, this helical extension will serve to better define and control front ends, thereby eliminating or at least substantially minimizing hooking. Tail ends will be both radially and axially confined along at least an additional 3601 path extending around axis A, thereby resisting any tendency of the product to buckle, while providing a more reliable and consistent circular shape to the last ring of each rod section.

Frictional contact between the high speed rods and the shroud 54 will provide a beneficial absorption of excess energy after the tail end clears the pinch roll unit 16. This effect can be controlled by rotating the shroud 54. Rotating the shroud 54 in a direction opposite to that of the product exiting from the laying pipe 46 will result in energy absorption. With larger rods, rotation of the shroud in the direction of the exiting product will impart energy and assist the exiting of the tail end.

When larger diameter slower speed rods are being rolled, additional guidance beyond that being provided by the laying pipe is not required and indeed may be detrimental. Thus, the inner component 50 is simply dismantled and removed from the laying head. This can be accomplished quickly by simply loosening and detaching the threaded sleeve 88 from the stem 82. All other components, including the shroud 54, can remain in place.

We claim:

1. A laying head for forming an axially moving elongated product into a series of rings, said laying head comprising:

an elongated tubular support;

means for rotating said support about its longitudinal axis;

a pipe carried by said support for rotation therewith, said pipe having an inlet end aligned with said axis and arranged to receive said product, and having an intermediate portion defining a curved guide path leading from said inlet end to an outlet end arranged to rotate about said axis and from which said product is discharged in the form of a continuous series of rings; and guide means communicating with said outlet end for defining a helical extension of said guide path, said guide means including a cylindrical shroud surrounding the rotational path of said outlet end and a helical trough having its open side facing said shroud.

2. The laying head a claimed in claim 1 wherein the helical extension of said guide path defines at least one complete revolution about said axis.

3. The laying head as claimed in claim 1 further comprising mounting means for detachably securing said helical trough to said tubular support.

4. The laying head as claimed in claim 3 wherein said tubular support has a front end adjacent to the inlet end of said pipe and a rear end adjacent to a plane containing the rotational path of the outlet end of said pipe, and wherein said mounting means includes a central hub received in the rear end of said support.

5. The laying head as claimed in claim 4 wherein said central hub has axially spaced first and second external locating surfaces surrounded by and engageable respectively with axially spaced first and second internal locating surfaces on said tubular support.

6. The laying head as claimed in claim 5 wherein said first internal and external locating surfaces are tapered.

7. The laying head as claimed in claim 5 wherein said second internal and external locating surfaces are cylindrically shaped.

8. The laying head as claimed in any one of claims 6 or 7 wherein said first and second internal and external locating surfaces are arranged concentrically with respect to said axis.

9. The laying head as claimed in claim 6 further comprising means for axially urging said first internal and external locating surfaces into wedged interengagement.

10. The laying head as claimed in claim 9 wherein said means includes a threaded member secured to said support and lying on said axis, and a nut coupled to said hub and threaded on said threaded member.

11. The laying head as claimed in claim 1 wherein said guide means is radially subdivided into inner and outer components, said inner component being detachably secured to said support for rotation therewith in relation to said outer component.

12. The laying head as claimed in claim 11 wherein said outer component comprises a cylindrical shroud, and said inner component comprises a helical trough having its open side facing radially outwardly towards said shroud.

13. The laying head as claimed in claim 1 further comprising means for rotating said cylindrical shroud about said axis.

14. A laying head for forming an axially moving elongated product into a series of rings, said laying head comprising:

an elongated tubular support;

means for rotating said support about its longitudinal axis;

a pipe carried by said support for rotation therewith, said pipe having an inlet end aligned with said axis and arranged to receive said product, and having an intermediate portion defining a curved guide path leading from said inlet end to an outlet end arranged to rotate about said axis and from which said product is discharged in the form of a continuous series of rings;

guide means communicating with said outlet end for defining a helical extension of said guide path; and mounting means for detachably securing said guide means to said tubular support, wherein said tubular support has a front end adjacent to the inlet end of said pipe and a rear end adjacent to a plane containing the rotational path of the outlet end of said pipe, and wherein said mounting means includes a central hub received in the rear end of said support, said central hub having axially spaced first and second external locating surfaces surrounded by and engagable respectively with axially spaced first and second internal locating surfaces on said tubular support.

15. The laying head as claimed in claim 14 wherein said guide means includes a cylindrical shroud surrounding the rotational path of said outlet end.

16. The laying head as claimed in claim 15 wherein said guide means further includes a helical trough having its open side facing said shroud.

17. The laying head as claimed in claim 16 wherein said mounting means detachably secures said helical trough to said tubular support.

18. The laying head as claimed in any one of claims 14–16 wherein the helical extension of said guide path defines at least one complete revolution about said axis.

19. The laying head as claimed in claim 15 further comprising means for rotating said cylindrical shroud about said axis.

20. The laying pipe as claimed in claim 14 wherein said guide means is radially subdivided into inner and outer components, said inner component being detachably secured to said support for rotation therewith in relation to said outer component.

21. The laying pipe as claimed in claim 20 wherein said outer component comprises a cylindrical shroud, and said inner component comprises a helical trough having its open side facing radially outwardly towards said shroud.

22. The laying head as claimed in claim 18 wherein said first internal and external locating surfaces are tapered.

23. The laying head as claimed in claim 22 further comprising means for axially urging said first internal and external locating surfaces into wedged interengagement.

24. The laying head as claimed in claim 23 wherein said means includes a threaded member secured to said support and lying on said axis, and a nut coupled to said hub and threaded on said threaded member.

25. The laying head as claimed in claim 18 wherein said second internal and external locating surfaces are cylindrically shaped.

26. The laying head as claimed in any one of claims 22 or 25 wherein said first and second internal and external locating surfaces are arranged concentrically with respect to said axis.

27. A laying head for forming an axially moving elongated product into a series of rings, said laying head comprising:

an elongated tubular support;

means for rotating said support about its longitudinal axis;

a pipe carried by said support for rotation therewith, said pipe having an inlet end aligned with said axis and arranged to receive said product, and having an intermediate portion defining a curved guide path leading from said inlet end to an outlet end arranged to rotate about said axis and from which said product is discharged in the form of a continuous series of rings; and guide means communicating with said outlet end for defining a helical extension of said guide path, said guide means being radially subdivided into inner and outer components, said inner component being detachably secured to said support for rotation therewith in relative to said outer component, wherein said outer component comprises a cylindrical shroud surrounding the rotational path of said outlet end, and said inner component comprises a helical trough having its open side facing said shroud.

28. The laying head as claimed in claim 27 wherein the helical extension of said guide path defines at least one complete revolution about said axis.

29. The laying head as claimed in claim 27 further comprising mounting means for detachably securing said helical trough to said tubular support.

30. The laying head as claimed in claim 29 wherein said tubular support has a front end adjacent to the inlet end of said pipe and a rear end adjacent to a plane containing the rotational path of the outlet end of said pipe, and wherein said mounting means includes a central hub received in the rear end of said support.

31. The laying head as claimed in claim 30 wherein said central hub has axially spaced first and second external locating surfaces surrounded by and engageable respectively with axially spaced first and second internal locating surfaces on said tubular support.

32. The laying head as claimed in claim 31 wherein said first internal and external locating surfaces are tapered.

33. The laying head as claimed in claim 32 further comprising means for axially urging said first internal and external locating surfaces into wedged interengagement.

34. The laying head as claimed in claim 33 wherein said means includes a threaded member secured to said support and lying on said axis, and a nut coupled to said hub and threaded on said threaded member.

35. The laying head as claimed in claim 31 wherein said second internal and external locating surfaces are cylindrically shaped.

36. The laying head as claimed in any one of claims 32 or 35 wherein said first and second internal and external locating surfaces are arranged concentrically with respect to said axis.

37. The laying head as claimed in claim 27 further comprising means for rotating said cylindrical shroud about said axis.

* * * * *